US009474364B2

(12) United States Patent
Sorrell

(10) Patent No.: US 9,474,364 B2
(45) **Date of Patent: *Oct. 25, 2016**

(54) PORTABLE DESK DEVICE

(71) Applicant: Todd Sorrell, Kaneohe, HI (US)

(72) Inventor: Todd Sorrell, Kaneohe, HI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/070,257

(22) Filed: Mar. 15, 2016

(65) Prior Publication Data

US 2016/0192772 A1 Jul. 7, 2016

Related U.S. Application Data

(63) Continuation of application No. 14/681,323, filed on Apr. 8, 2015, now Pat. No. 9,320,351.

(60) Provisional application No. 62/000,737, filed on May 20, 2014.

(51) Int. Cl.

| | |
|---|---|
| ***A47B 3/00*** | (2006.01) |
| ***A47B 3/08*** | (2006.01) |
| ***A47B 3/12*** | (2006.01) |
| ***A47B 3/06*** | (2006.01) |
| ***A47B 3/10*** | (2006.01) |
| ***A47B 13/00*** | (2006.01) |
| ***A47B 13/08*** | (2006.01) |

(52) U.S. Cl.

CPC ..... *A47B 3/08* (2013.01); *A47B 3/002* (2013.01); *A47B 3/06* (2013.01); *A47B 3/10* (2013.01); *A47B 3/12* (2013.01); *A47B 13/003* (2013.01); *A47B 13/08* (2013.01); *Y10T 29/49828* (2015.01)

(58) Field of Classification Search

CPC ..... A47B 3/00; A47B 3/08; A47B 3/12; A47B 3/002; A47B 3/06; A47B 3/091; A47B 3/10; A47B 13/003; A47B 13/08; Y10T 29/49828

USPC ..... 108/115, 27, 157.11, 157.1, 157.17, 108/157.15, 159.12, 157.16, 159

See application file for complete search history.

(56) References Cited

U.S. PATENT DOCUMENTS

| | | | | |
|---|---|---|---|---|
| 3,106,295 | A | 10/1963 | Berlin | |
| 3,106,296 | A | 10/1963 | Walsh et al. | |
| 3,908,564 | A | 9/1975 | Miller et al. | |
| 3,997,139 | A | 12/1976 | Young et al. | |
| 4,098,486 | A | 7/1978 | Hornsby | |
| 4,974,526 | A | 12/1990 | Wiygul, Jr. | |
| 5,943,968 | A * | 8/1999 | Dobson | A47B 3/12 108/124 |
| 5,954,412 | A | 9/1999 | Rutherford et al. | |
| 6,082,838 | A | 7/2000 | Bissu-Palombo | |

(Continued)

*Primary Examiner* — Jose V Chen

(74) *Attorney, Agent, or Firm* — Global Intellectual Property Agency, LLC; Daniel Boudwin

(57) ABSTRACT

A portable desk device for storing items and providing a workplace surface. The device includes a desktop having a circular shaped cutout in which objects can be placed. The cutout can be used as a drink holder or for storing items, such as writing utensils. The desktop can further include a storage compartment located beneath the desktop surface, wherein books, magazines, electronic devices, and the like can be stored. The device further includes a foldable frame that supports and removably attaches to the desktop. The frame includes a pair of U-shaped side rails having a pair of vertical legs connected by a horizontal rail. The U-shaped side rails are connected by a crossbar. The frame further includes a hinge disposed in the horizontal rails so to allow the frame to be folded in a compact configuration.

15 Claims, 3 Drawing Sheets

(56) References Cited

U.S. PATENT DOCUMENTS

| | | | | |
|---|---|---|---|---|
| 6,260,428 | B1 | 7/2001 | Clement | |
| 6,545,864 | B2 | 4/2003 | Davis, IV | |
| 7,798,075 | B2 | 9/2010 | Bettinger | |
| 8,056,871 | B2 | 11/2011 | Matias | |
| 8,567,878 | B2 | 10/2013 | Wylie | |
| 8,596,449 | B2 | 12/2013 | Mongan et al. | |
| 9,320,351 | B2 * | 4/2016 | Sorrell | 108/115 |
| 2005/0051062 | A1 | 3/2005 | Tetley | |
| 2005/0061212 | A1 | 3/2005 | Lockwood et al. | |
| 2013/0134282 | A1 | 5/2013 | Negretti | |

* cited by examiner

PORTABLE DESK DEVICE

CROSS REFERENCE TO RELATED APPLICATIONS

This application is a continuation of U.S. patent application Ser. No. 14/681,323 filed on Apr. 8, 2015, which is a nonprovisional of U.S. Provisional Application No. 62/000,737 filed on May 20, 2014. The above identified patent applications are herein incorporated by reference in their entirety to provide continuity of disclosure.

BACKGROUND OF THE INVENTION

The present invention relates to portable desk devices. More specifically, the present invention provides a desktop having a circular shaped cutout in which objects can be placed. The desktop further includes a storage compartment located beneath the desktop surface, wherein books, magazines, electronic devices, and the like can be stored. The device further includes a foldable frame that supports and removably attaches to the desktop. The frame includes a pair of U-shaped side rails having a pair of vertical legs connected by a horizontal rail. The U-shaped side rails are connected by a crossbar. The frame further includes a hinge disposed in the horizontal rails so to allow the frame to be folded in a compact configuration. The desktop includes a first side opposite a second side, wherein each side includes a U-shaped lip adapted to fit over the horizontal rails or vertical legs of the frame.

It can be difficult to find proper storage space for personal items when in a bathroom or other household living areas. Many individuals resort to placing books, mobile phones, or magazines on top of a toilet or on the floor which can create a messy and unorganized appearance. If in a bathroom, these items can mistakenly fall into the toilet bowl and become damaged. In other household areas, these items can lead to clutter and easily become misplaced. Additionally, individuals typically do not have desks available in a bathroom or other living areas, but would benefit from having a surface area to work or read on while in a bathroom or sitting on a couch.

SUMMARY OF THE INVENTION

In view of the foregoing disadvantages inherent in the known types of portable desk devices now present in the prior art, the present invention provides a new portable desk device wherein the same can be utilized for providing convenience for the user when storing household items, requiring a workplace desktop.

It is therefore an object of the present invention to provide a new and improved portable desk device that has all of the advantages of the prior art and none of the disadvantages.

It is another object of the present invention to provide a portable desk device comprising a desktop having a circular shaped cutout and a storage compartment located below the desktop surface.

Another object of the present invention is to provide a portable desk device wherein the desktop is supported by a foldable frame, wherein the frame includes a pair of U-shaped side rails having a pair of vertical legs connected by a horizontal rail, wherein the U-shaped side rails are connected by a crossbar.

Another object of the present invention is to provide a portable desk device that may be readily fabricated from materials that permit relative economy and are commensurate with durability.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
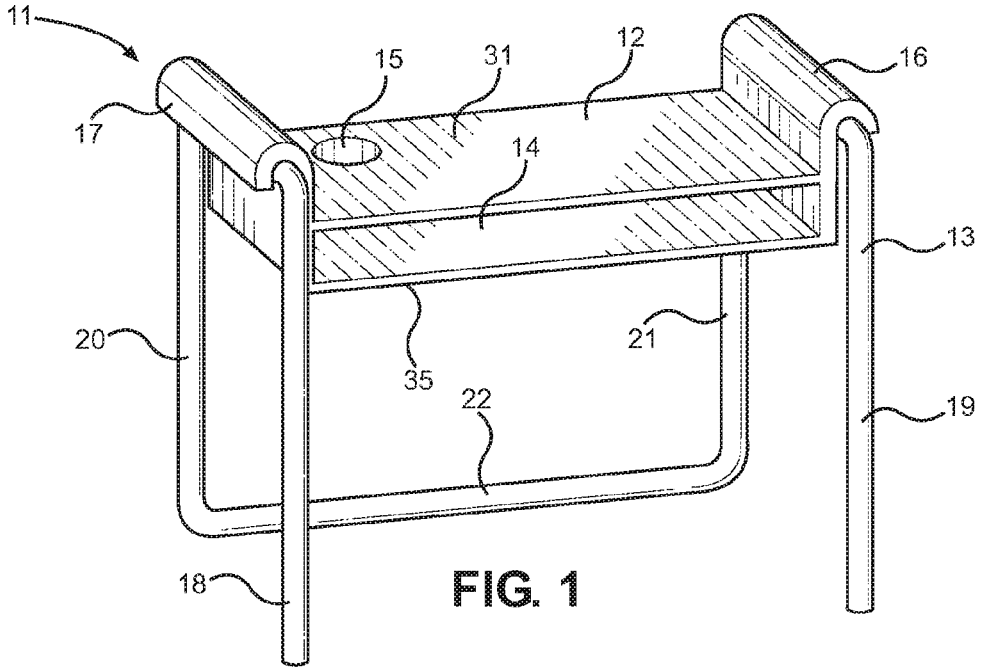
FIG. 1 shows a perspective view of an embodiment of the portable desk device.

Reference is made herein to the attached drawings. Like reference numerals are used throughout the drawings to depict like or similar elements of the portable desk device. The figures are intended for representative purposes only and should not be considered to be limiting in any respect.

Figure 2:
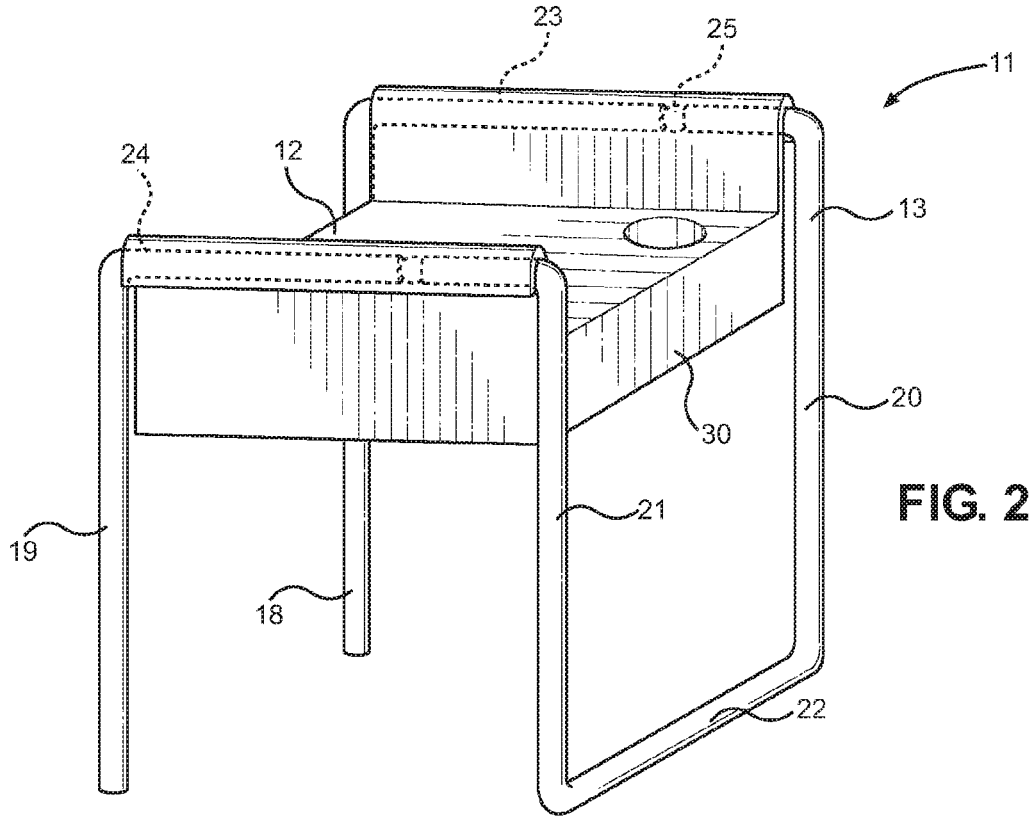
FIG. 2 shows a perspective view of the horizontal rails of the frame beneath the desktop of the portable desk device.

Referring now to FIGS. 1 and 2, there is shown a perspective view of an embodiment of the portable desk device and a perspective view of the horizontal rails of the frame beneath the desktop of the portable desk device, respectively. The portable desk device 11 comprises a desktop 12 and a frame 13, wherein the frame 13 is foldable. The desktop 12 is supported by the frame 13 and is removably secured thereto. The desktop includes a rear side 30 and a first side 16 opposite a second side 17, wherein the first and second sides 16, 17 include a U-shaped lip adapted to be placed over the frame 13. The desktop 12 is preferably rectangular in configuration and comprises one or more storage compartments 14 adapted to receive items such as books, magazines, and electronic devices therein. The storage compartment 14 is also preferably rectangular and comprises the horizontal space between the upper surface 31 of the desktop and the bottom surface 35 of the desktop 12.

The upper surface 31 of the desktop 12 comprises one or more circular cutouts 15 adapted to receive objects therein. The circular cutout 15 can include a cup therein so the base of the cup rests on the bottom surface 35 of the desktop 12. In some embodiments, the cutout can include a cylindrical recessed section, wherein the upper edge of the section is flush with the upper surface 31 of the desktop and the base of the cylindrical recessed section is disposed above the bottom surface 35 of desktop 12. In this way, the cylindrical recessed section does not contact the bottom surface 35 of the desktop 12. In some embodiments, the cutout can be any configuration, such as a square or rectangle. The upper surface 31 of the desktop 12 is flat so it can be used as a working surface on which various items can be placed, such as laptop computers, tablets, and magazines.

The frame 13 comprises a first U-shaped side rail and a second U-shaped side rail, wherein each U-shaped side rail comprises a pair of vertical legs 18-21 connected by a horizontal rail 23, 24. The side rails are arranged parallel to one another and are connected by a crossbar 22. In the illustrated embodiment, the first U-shaped side rail includes a first vertical leg 18, wherein the upper end of the leg 18 is connected to the first end of a horizontal rail 23 and the second end of the horizontal rail 23 is connected to the upper end of a second vertical leg 20. The second U-shaped side rail includes a first vertical leg 19, wherein the upper end of the leg 19 is connected to the first end of a horizontal rail 24 and the second end of the horizontal rail 24 is connected to the upper end of a second vertical leg 21. A horizontal crossbar 22 connects the second leg 20 of the first side rail to the second leg 21 of the second side rail. The crossbar 22 is disposed between the lower ends of the vertical legs 20, 21. The frame 13 can be constructed from hard plastic, metal, or other suitable materials.

Figure 4:
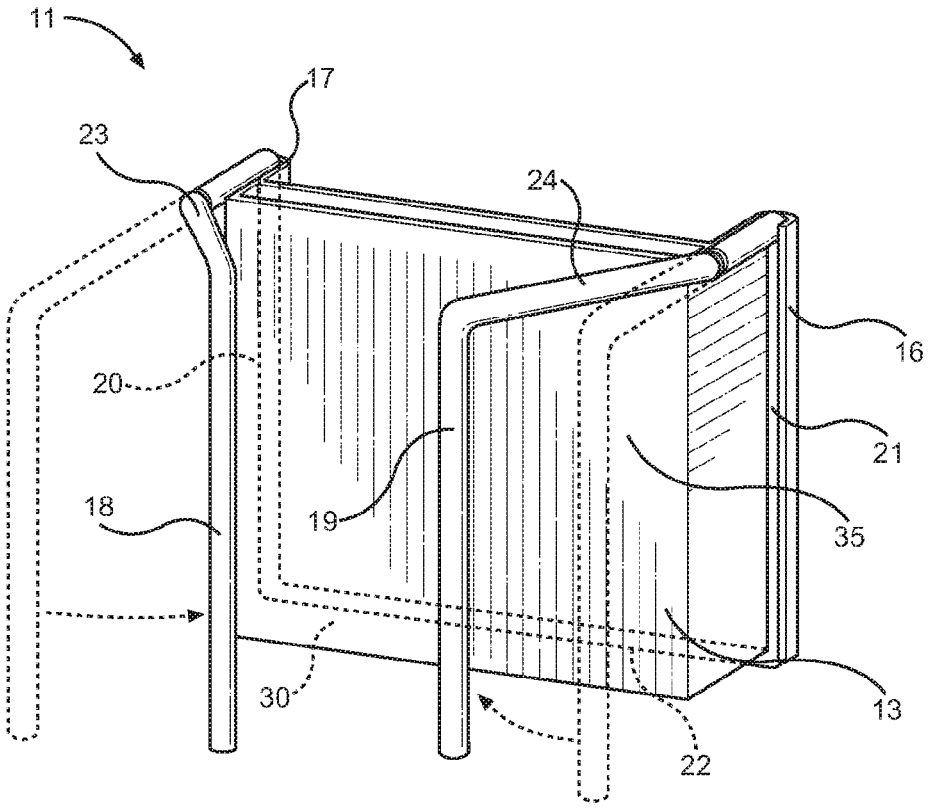
FIG. 4 shows a perspective view of an embodiment of the portable desk device in a partially folded position.

The U-shaped lips 16, 17 are adapted to fit over the horizontal rails 23, 24 or the vertical legs 20, 21 connected by the crossbar 22. The device can be used as a working desktop or folded into a compacted configuration for storage. It can be used as a working desktop for performing various tasks, such as reading, writing, typing, on which many items can be placed, such as laptop computers, tablets, and the like. When the device 11 is used as a working desktop, the U-shaped lips 16, 17 removably secure onto the horizontal rails 23, 24. When the device 11 is folded into a compacted configuration as illustrated in FIG. 4, the U-shaped lips removably secure onto the vertical legs 20, 21 connected by the crossbar 22. The width of the horizontal rails 23, 24 and the vertical legs 20, 21 connected by the crossbar 22 is similar to the width of the opening under the U-shaped lip 16, 17 so that the desktop 12 can be securely disposed thereon. In some embodiments, the U-shaped lip 16, 17 can include one or more removable fasteners, such as a clip, adapted to engage the horizontal rails 23, 24 or the vertical legs 20, 21 connected by the crossbar in order to further secure the desktop 12 to the frame 13. The horizontal rails 23, 24 and U-shaped lips 16, 17 can be grasped and the frame 13 used as a support in order to aid with sitting down or getting up from a toilet seat, chair, and the like.

The frame 13 is foldable and includes hinges 25 adapted to allow the frame 13 to be folded into a compact configuration for storage. Each horizontal rail 23, 24 includes a hinge 25 adapted to allow the horizontal rails 23, 24 to fold. In the illustrated embodiment, a ball hinge 25 is disposed in the horizontal rails 23, 24. However, any suitable type of hinge 25 can be disposed in the horizontal rails 23, 24. The diameter of the ball hinge 25 is substantially the same diameter of the horizontal rails 23, 24 so the U-shaped lips 16, 17 of the desktop can be disposed thereon without any obstruction from the hinge 25.

Figure 3:
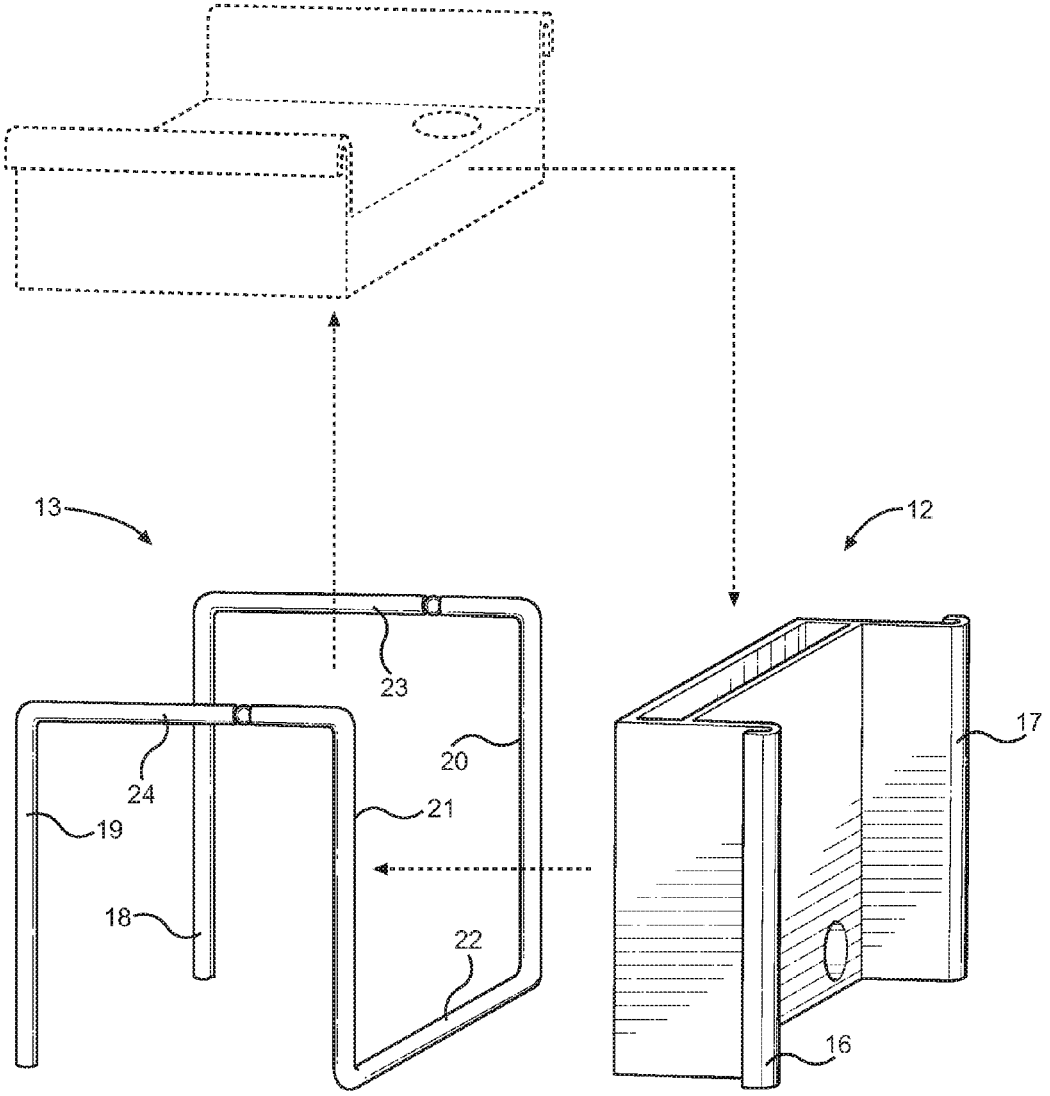
FIG. 3 shows a perspective view of the desktop being repositioned on the frame of the portable desk device.

Referring now to FIG. 3, there is shown a perspective view of the desktop being repositioned on the frame of the portable desk device. Before folding the device for storage, the desktop is repositioned on the frame. To reposition the desktop 12 on the frame 13, the U-shaped lips 16, 17 of the desktop 12 are separated from the horizontal rails 23, 24. Then, the U-shaped lips 16, 17 are disposed on the vertical legs 20, 21 connected by the crossbar 22 so the crossbar 22 is disposed along the rear side 30 of the desktop 12. In this way, the crossbar prevents the U-shaped lips 16, 17 from being positioned beyond the vertical legs 20, 21 and preventing the desktop 12 from falling off of the frame 13.

Figure 5:
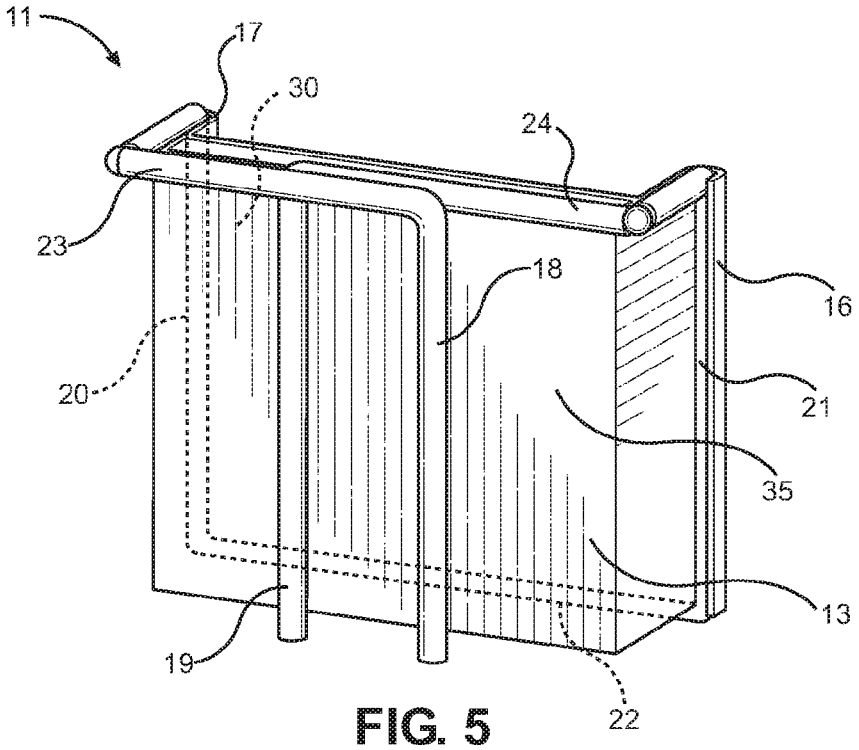
FIG. 5 shows a perspective view of an embodiment of the portable desk device in a folded position.

Referring now to FIGS. 4 and 5, there is shown a perspective view of an embodiment of the portable desk device in a partially folded position and a folded position, respectively. Once the desktop 12 is repositioned on the frame 13, the first vertical leg 19 and the horizontal rail 24 of the second U-shaped side rail can be folded toward the second vertical leg 20 of the first U-shaped side rail until the first leg 19 and horizontal rail 24 become flush against the bottom surface 35 of the desktop 12. Next, the first vertical leg 18 and the horizontal rail 23 of the first U-shaped side rail can be folded toward the second vertical leg 21 of the second U-shaped side rail. In this way, the device can be transported to a desired location, such as the bathroom.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable desk device comprising:

a desktop including a first side opposite a second side, the first side including a first U-shaped lip and the second side including a second U-shaped lip;

a frame including a first U-shaped side rail and a second U-shaped side rail arranged parallel to one another and connected by a crossbar;

the first U-shaped side rail and the second U-shaped side rail each comprising a pair of vertical legs connected by a horizontal rail;

a hinge disposed along the horizontal rail of each of the first U-shaped side rail and the second U-shaped side rail;

wherein the first U-shaped lip of the desktop is removably securable to either of the horizontal rail of the first U-shaped side rail or to a vertical leg of the first U-shaped side rail connected to the crossbar; and wherein the second U-shaped lip of the desktop is removably securable to either of the horizontal rail of the second U-shaped side rail or a vertical leg of the second U-shaped side rail connected to the crossbar.

2. The portable desk device of claim 1, wherein the hinge is configured to allow one of the pair of vertical legs for each of the first U-shaped side rail and the second U-shaped side rail to pivot between a first position wherein each of the pair of vertical legs are aligned and a second position wherein each of the pair of vertical legs are unaligned.

3. The portable desk device of claim 1, wherein the hinge is configured to pivot one of the pair of vertical legs for each of the first U-shaped side rail and the second U-shaped side rail between an extended position and an inward collapsed position.

4. The portable desk device of claim 1, wherein the hinge includes a ball hinge.

5. The portable desk device of claim 1, wherein the desktop includes one or more storage compartments disposed between an upper surface and a bottom surface of the desktop.

6. The portable desk device of claim 1, wherein the desktop comprises one or more cutouts.

7. The portable desk device of claim 1, wherein a width of the hinge is substantially equal to a width of the horizontal bar.

8. A portable desk device comprising:

a desktop including a first side opposite a second side, the first side including a first lip and the second side including a second lip;

a frame including:

a first vertical leg;

a second vertical leg;

a third vertical leg;

a fourth vertical leg;

a first horizontal rail connecting the first vertical leg and the third vertical leg;

a second horizontal rail connecting the second vertical leg and the fourth vertical leg;

a crossbar connecting the third vertical leg and the fourth vertical leg, the crossbar extending from a distal end of the third vertical leg to a distal end of the fourth vertical leg;

a hinge disposed along each of the first horizontal rail and the second horizontal rail;

wherein the desktop is removably securable to the frame via engagement of the first lip with the first horizontal rail and engagement of the second lip with the second horizontal rail; and wherein the desktop is removably securable to the frame via engagement of the first lip with the third vertical leg and engagement of the second lip with the fourth vertical leg.

9. The portable desk device of claim 8, wherein:

the hinge of the first horizontal rail is configured to allow the first vertical leg to pivot between a position wherein the first vertical leg is aligned with the third vertical leg and a position wherein the first vertical leg is unaligned with the third vertical leg;

the hinge of the second horizontal rail is configured to allow the second vertical leg to pivot between a position wherein the second vertical leg is aligned with the fourth vertical leg and a position wherein the second vertical leg is unaligned with the fourth vertical leg.

10. The portable desk device of claim 8, wherein:

the hinge of the first horizontal rail is configured to allow the first vertical leg to pivot between an extended position and an inward collapsed position;

the hinge of the second horizontal rail is configured to allow the second vertical leg to pivot between an extended position and an inward collapsed position.

11. The portable desk device of claim 8, wherein:

the hinge of the first horizontal rail is configured to allow the first vertical leg to pivot between an extended position and a collapsed position wherein the first vertical leg rests flush against a bottom surface of the desktop when the desktop is secured to the third vertical leg and the fourth vertical leg;

the hinge of the second horizontal rail is configured to allow the second vertical leg to pivot between an extended position and a collapsed position wherein the second vertical leg rests flush against the bottom surface of the desktop when the desktop is secured to the third vertical leg and the fourth vertical leg.

12. The portable desk device of claim 8, wherein a width of the hinge is substantially equal to a width of the first horizontal rail and the second horizontal rail.

13. The portable desk device of claim 8, wherein the hinge includes a ball hinge.

14. The portable desk device of claim 8, wherein the desktop includes one or more storage compartments.

15. The portable desk device of claim 8, wherein the crossbar is configured to prevent the desktop from slipping from the frame when the desktop is secured to the third vertical leg and the fourth vertical leg.

* * * * *